US011805863B1

(12) United States Patent
Decker

(10) Patent No.: US 11,805,863 B1
(45) Date of Patent: Nov. 7, 2023

(54) ELONGATED STRAP WITH FASTENER AND TWO MAGNETIC ELEMENTS

(71) Applicant: Kathrina Decker, Hanska, MN (US)

(72) Inventor: Kathrina Decker, Hanska, MN (US)

( * ) Notice: Subject to any disclaimer, the term of this patent is extended or adjusted under 35 U.S.C. 154(b) by 0 days.

(21) Appl. No.: 17/406,066

(22) Filed: Aug. 18, 2021

Related U.S. Application Data

(60) Provisional application No. 63/077,616, filed on Sep. 12, 2020.

(51) Int. Cl.
*A44B 13/00* (2006.01)
*A45C 13/10* (2006.01)

(52) U.S. Cl.
CPC ..... *A44B 13/0029* (2013.01); *A45C 13/10* (2013.01); *A44D 2203/00* (2013.01); *A45C 2013/1015* (2013.01)

(58) Field of Classification Search
CPC ..... A44B 13/0029; A45C 13/10; A45C 2013/1015; A44D 2203/00; A45F 5/02; A45F 2200/0558; A45F 2005/006; Y10T 24/32; A41F 1/002
See application file for complete search history.

(56) References Cited

U.S. PATENT DOCUMENTS

| | | | |
|---|---|---|---|
| X804545 | | 11/1905 | Paine |
| 2,455,968 | A | 12/1948 | Baker |
| 4,226,105 | A | 10/1980 | Wehrman |
| 4,249,267 | A | 2/1981 | Voss |
| 4,940,250 | A | 7/1990 | Corrado |
| 5,388,439 | A | 2/1995 | Miller |
| 6,101,688 | A | 8/2000 | Marchesi |
| 6,273,245 | B1 | 8/2001 | Mickelson |
| 6,339,848 | B1 * | 1/2002 | Mayhood ..... A41F 9/002 2/338 |
| 6,836,899 | B1 | 1/2005 | Glasmire |
| 7,120,972 | B2 | 10/2006 | O'Banion |
| 7,665,684 | B2 | 2/2010 | Salentine et al. |
| D611,678 | S | 3/2010 | Bailey |
| 7,817,002 | B2 | 10/2010 | Fullerton et al. |
| 8,261,416 | B2 | 9/2012 | Rothbaum et al. |
| 8,403,140 | B2 | 3/2013 | Woolery |
| D699,002 | S * | 2/2014 | Connolly ..... D3/215 |
| 8,841,556 | B2 | 9/2014 | Rothbaum |
| 9,603,401 | B2 | 3/2017 | Pruitt et al. |
| 9,930,985 | B2 | 4/2018 | Daring |
| 10,012,346 | B2 | 7/2018 | Killion et al. |

(Continued)

OTHER PUBLICATIONS

"STRAP14—Magstrapz 14in Strap," Web Page <https://www.wensco.com/itemdetail/strap14>, Wensco Sign Supply, Grand Rapids, Michigan, United States, 2 pages, retrieved on Sep. 10, 2020.

(Continued)

*Primary Examiner* — Robert Sandy
*Assistant Examiner* — Rowland Do
(74) *Attorney, Agent, or Firm* — Lund IP, PLLC

(57) ABSTRACT

An assembly includes an elongated strap with a length extending between a first end and a second end, a first magnetic element proximate the first end of the strap, a second magnetic element proximate the second end of the strap, and a fastener attached to the first end of the strap. In some examples, at least one of the first and second magnetic elements is a rare earth magnet.

20 Claims, 11 Drawing Sheets

(56) References Cited

U.S. PATENT DOCUMENTS

| | | | | |
|---|---|---|---|---|
| D862,068 | S | 10/2019 | Justiss | |
| 10,736,408 | B2 | 8/2020 | Paillasson | |
| 2007/0006367 | A1 | 1/2007 | Newman et al. | |
| 2008/0104742 | A1* | 5/2008 | Alperin | A41F 17/02 24/303 |
| 2009/0090753 | A1* | 4/2009 | Irvin | A45F 5/00 224/267 |
| 2009/0095039 | A1* | 4/2009 | Nagamine | A45F 5/00 70/456 R |
| 2010/0083699 | A1* | 4/2010 | Conigliaro | A45F 5/02 24/303 |
| 2012/0125046 | A1* | 5/2012 | Vander Wal | H01F 7/0263 24/303 |
| 2016/0353848 | A1* | 12/2016 | Whitaker | A45F 5/02 |

OTHER PUBLICATIONS

"Mag Kit Magnetic Strap," Web Page <https://www.flukenetworks.com/products/mag-kit-magnetic-strap>, Fluke Networks, 5 pages, retrieved on Sep. 10, 2020.

* cited by examiner

ELONGATED STRAP WITH FASTENER AND TWO MAGNETIC ELEMENTS

RELATED APPLICATION

This application claims the benefit of and priority to U.S. Provisional Application No. 63/077,616, filed Sep. 12, 2020, the entire contents of which are incorporated by reference herein.

TECHNICAL FIELD

This disclosure relates to mechanical fasteners and organization.

BRIEF SUMMARY

As disclosed herein, an assembly includes an elongated strap with a length extending between a first end and a second end, a first magnetic element proximate the first end of the strap, a second magnetic element proximate the second end of the strap, and a fastener attached to the first end of the strap.

The assembly is configured to be attached to a cloth, such as a purse or article of clothing, by pinching the cloth between the first magnetic element and the second magnetic element. The design of two magnetic elements and a fastener allows improved organization by allowing a user to secure keys or another object to the cloth. In some examples, at least one of the first and second magnetic elements is a rare earth magnet.

DETAILED DESCRIPTION

Figure 1A:
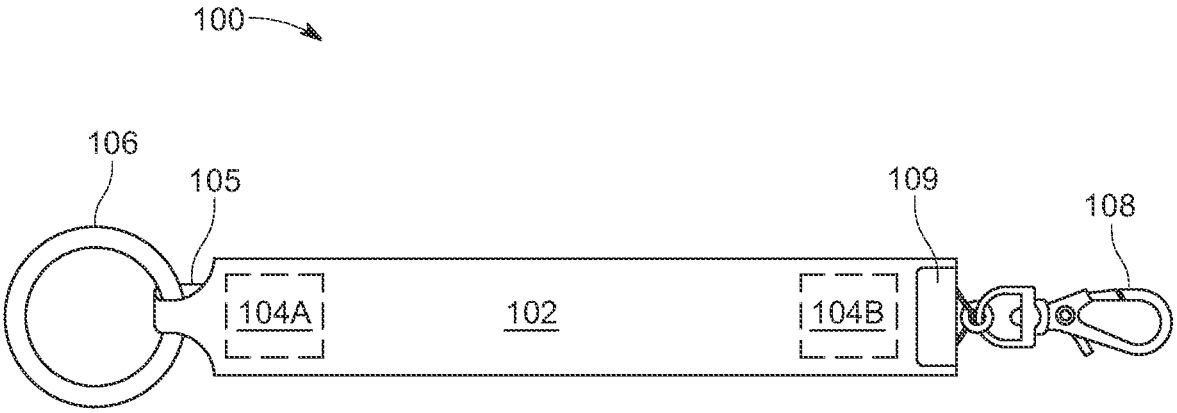
FIGS. 1A-9 illustrate assemblies 100, 200, 300, 400, 500, 600, 700, 800, 900 each including an elongated strap with two magnetic elements and a fastener on an end of the elongated strap.
Figure 1B:
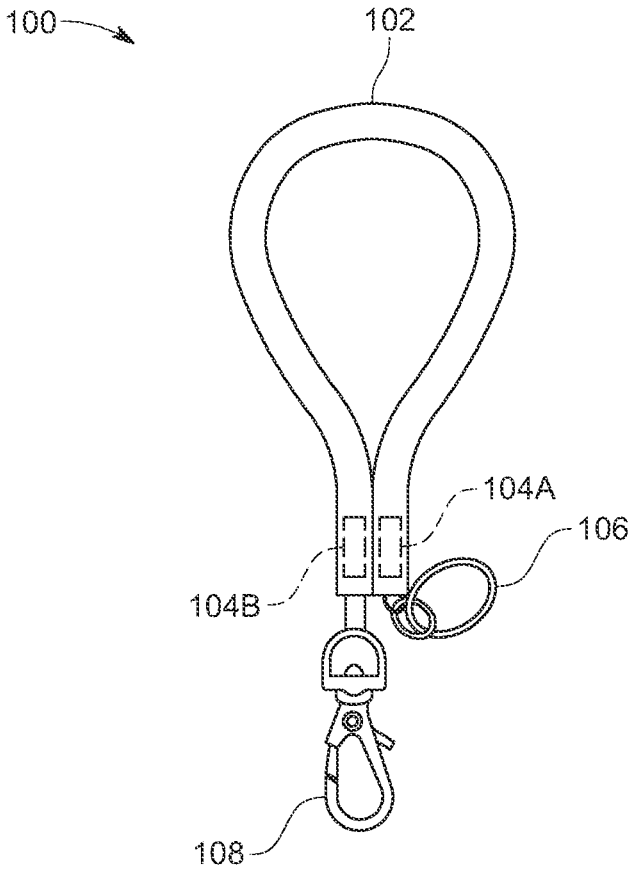
Figure 1C:
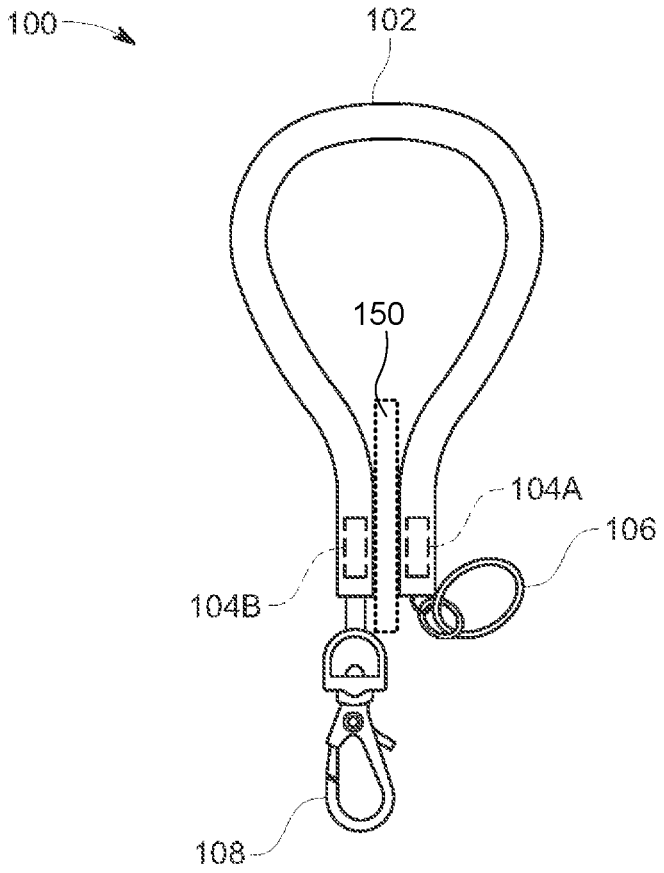

FIGS. 1A-1C illustrate assembly 100. Assembly 100 includes elongated strap 102. Elongated strap 102 defines a length extending between a first end and a second end, a first magnetic element 104A proximate the first end of strap 102, and a second magnetic element 104B proximate the second end of strap 102. Magnetic elements 104A, 104B are collectively referred to as magnetic elements 104.

Fastener 106 is attached to the first end of strap 102 through loop 105 of strap 102. Fastener 108 is attached to the second end of strap 102 with pinch fit base 109 of fastener 108 secured to the second end of strap 102. In the specific example of assembly 100, fastener 106 is a ring fastener, and fastener 108 is a clasp fastener, such as a lobster claw clasp. Fastener 108 includes an optional swivel between pinch fit base 109 and the clasp mechanism.

Any variety of fastener may be selected for one or both of fasteners 106, 108. Such fasteners may represent a clasp, such as the lobster claw clasp of fastener 108, a hook, such as an open hook, a spring-loaded hook or a snap hook, and/or a ring, such as a solid ring, a hinged opening ring, or a split ring.

FIGS. 1B and 1C illustrate assembly 100 with first magnetic element 104A magnetically coupled to second magnetic element 104B. Assembly 100 is configured to be attached to a cloth 150, such as a purse or article of clothing, by pinching the cloth 150 between first magnetic element 104A magnetically coupled to second magnetic element 104B, as shown in FIG. 1C. Fasteners 106, 108 allow improved organization by allowing a user to secure keys or another object to the cloth 150. In various examples, the cloth 150 may include textiles, leather, or synthetic materials, such as, but not limited to vinyl. The pinch fit of magnetic elements 104 covered by the material of strap 102 facilitates a secure connection of assembly 100 without damage to the cloth 150.

In various examples, magnetic elements 104 may comprise two permanent magnets or one permanent magnet and one ferromagnetic metal. Such permanent magnets may be permanent magnets comprising iron and/or rare earth magnets.

In some examples, elongated strap 102 is formed from a pliable material, such as a leather material, molded elastic material such as a plastic, or cloth material such as a woven fabric, such as nylon, cotton, polyester, wool, rayon, or other fabric. In the same or different examples, elongated strap 102 includes two layers with magnetic elements 104 between the layers such that elongated strap 102 covers magnetic elements 104.

In addition to attaching magnetic elements 104 to each other and/or pinching cloth objects between magnetic elements 104, magnetic elements 104 may also be used to attach metal objects to the ends of elongated strap 102. Elongated strap 102 may be wrapped around an object, such as a user's neck, arm, or wrist, such that assembly 100 may function as a lanyard. Moreover, elongated strap 102 may be wrapped around an object, such as a bag strap, or a handle, such as a bicycle, stroller, or shopping cart handle. Magnetic elements 104 may be attached to each other to secure assembly 100 to the strap, handle, or the user. In addition, fasteners 106, 108 may be used to attach assembly 100 to any object. In specific examples, fasteners 106, 108 may be used to attach assembly 100 to a bag, such as a purse or wristlet, such as assembly serves as the bag straps, including but not limited to purse straps, cross body bag straps, and/or wristlet straps. Depending on the intended use of assembly 100, the length of assembly 100 may vary from less than six inches to six feet or more. These are merely a few examples of how assembly 100 may be used to organize and removably attach objects to each other.

Figure 2:
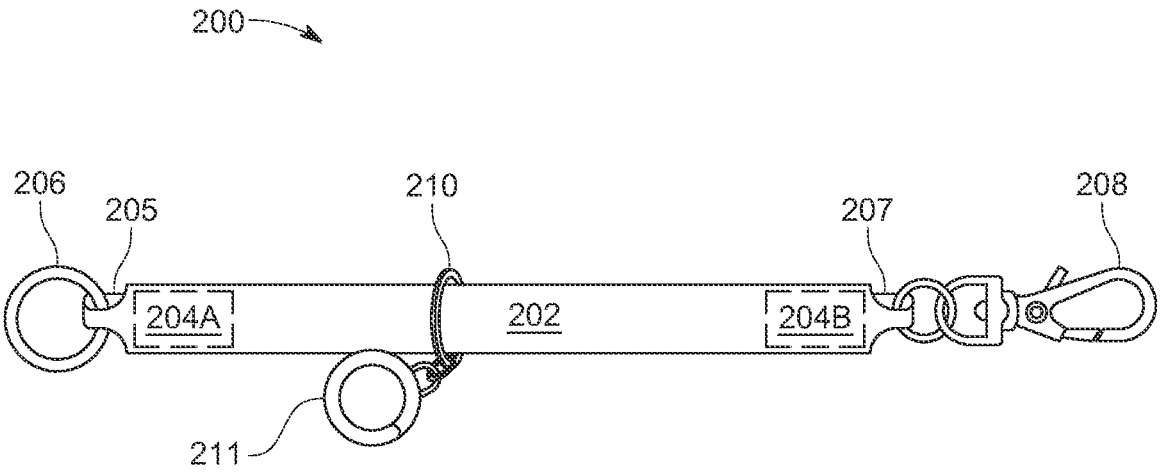

FIG. 2 illustrates assembly 200. Assembly 200 includes elongated strap 202. Elongated strap 202 defines a length extending between a first end and a second end, a first magnetic element 204A proximate the first end of strap 202, and a second magnetic element 204B proximate the second end of strap 202.

Fastener 206 is attached to the first end of strap 202 through loop 205 of strap 202. Fastener 208 is attached to the second end of strap 202 through loop 207 of strap 202. In the specific example of assembly 200, fastener 206 is a ring fastener, and fastener 208 is a clasp fastener, such as a lobster claw clasp. Fastener 208 includes an optional swivel between loop 207 and the clasp mechanism.

Assembly 200 is substantially similar to assembly 100 with the addition of a third fastener 211 including a loop 210 slideable over elongated strap 202. Fastener 211 includes a split ring fastener. For brevity, details of assembly 100 are not repeated with respect to assembly 200.

Figure 3:
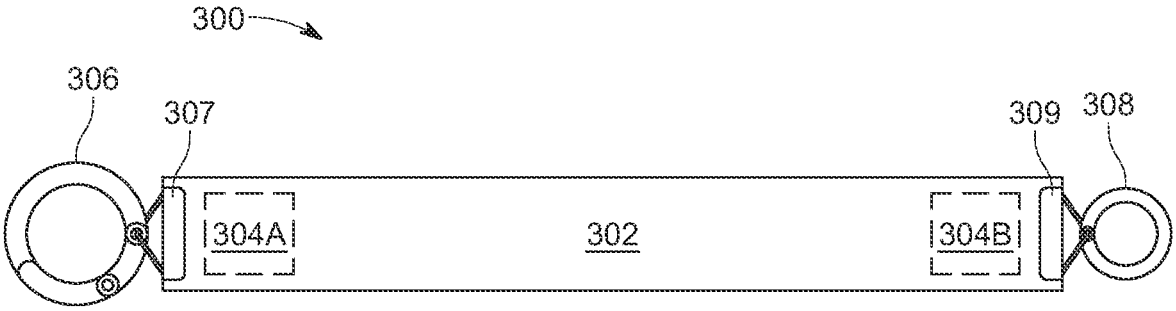

FIG. 3 illustrates assembly 300. Assembly 300 includes elongated strap 302. Elongated strap 302 defines a length extending between a first end and a second end, a first magnetic element 304A proximate the first end of strap 302, and a second magnetic element 304B proximate the second end of strap 302.

Fastener 306 is attached to the first end of strap 302 with pinch fit base 307 of fastener 306 secured to the first end of strap 302. Fastener 308 is attached to the second end of strap 302 with pinch fit base 309 of fastener 308 secured to the second end of strap 302. In the specific example of assembly 300, fastener 306 is a hinged ring fastener, and fastener 308 is a split ring fastener.

Assembly 300 is substantially similar to assembly 100 with except for different fastener configurations. For brevity, details of assembly 100 are not repeated with respect to assembly 300.

Figure 4:
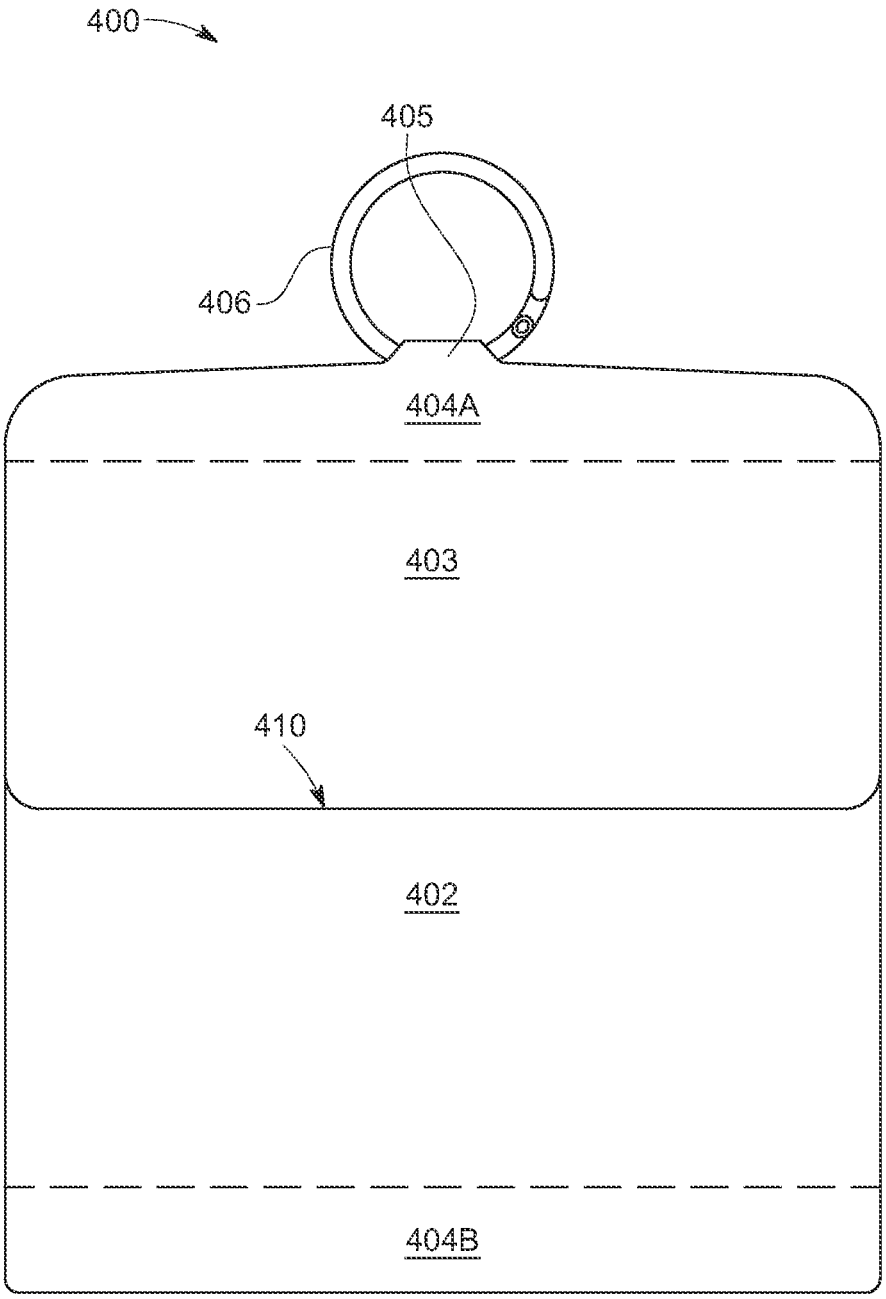

FIG. 4 illustrates assembly 400. Assembly 400 includes elongated strap 402. Elongated strap 402 defines a length extending between a first end and a second end, a first magnetic element 404A proximate the first end of strap 402, and a second magnetic element 404B proximate the second end of strap 402. Magnetic elements 404A, 404B are collectively referred to as magnetic elements 404.

Elongated strap 402 includes a pocket 410 and a cover 403. Cover 403 configured to close an opening of pocket 410 when first magnetic element 404A is magnetically coupled to second magnetic element 404B such that cover 403 is folded over the opening of pocket 410. Fastener 406 is attached to the first end of strap 402 through loop 405 of strap 402.

Any variety of fastener may be selected for fastener 406. Such fasteners may represent a clasp, such as the lobster claw clasp, a hook, such as an open hook, a spring-loaded hook or a snap hook, and/or a ring, such as a solid ring, a hinged opening ring, or a split ring.

In various examples, magnetic elements 404 may comprises two permanent magnets or one permanent magnet and one ferromagnetic metal. Such permanent magnets may be permanent magnets comprising iron and/or rare earth magnets, such as neodymium magnets.

In some examples, elongated strap 402 is formed from a cloth material such as a woven fabric, such as nylon, cotton, polyester, wool, rayon, or other fabric. In the same or different examples, elongated strap 402 includes at least two layers with magnetic elements 404 between the layers such that elongated strap 402 covers magnetic elements 404.

Figure 5:
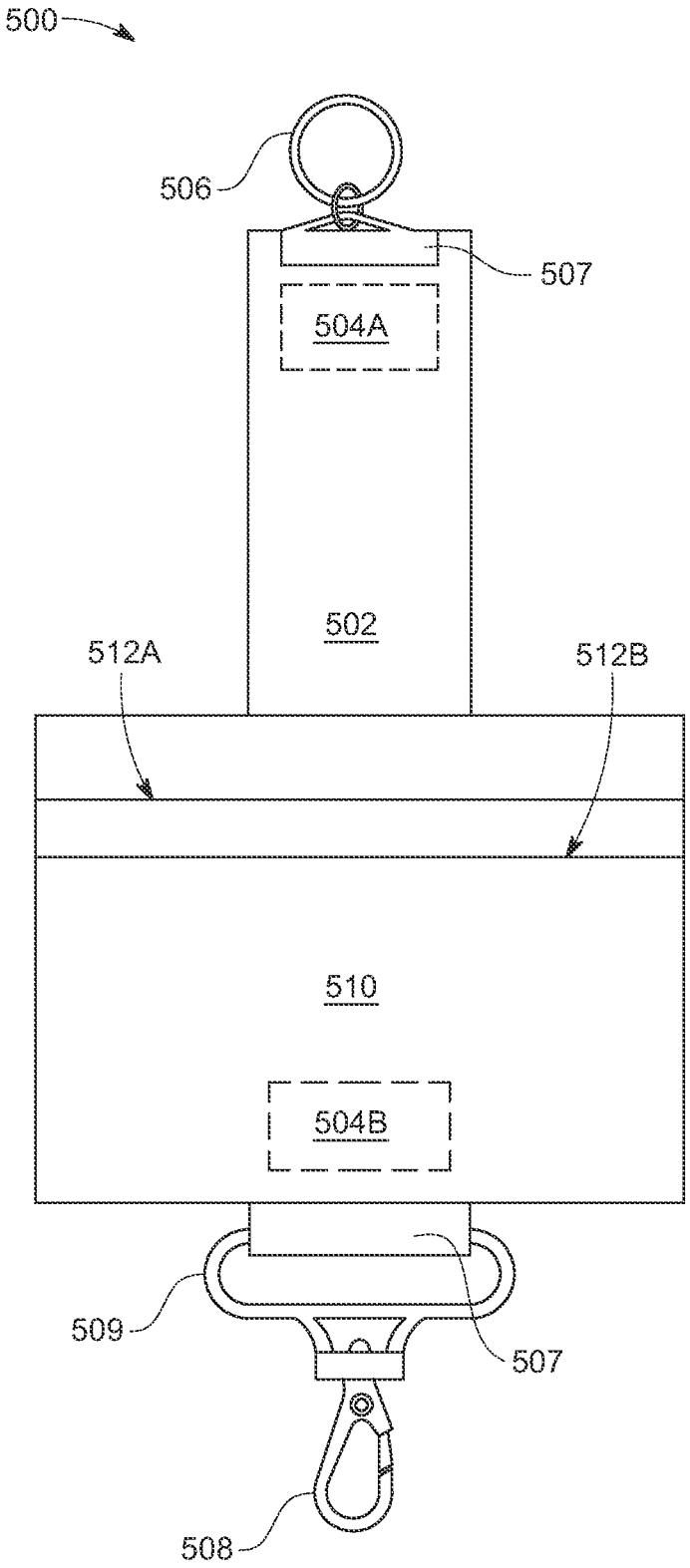

FIG. 5 illustrates assembly 500. Assembly 500 includes elongated strap 502. Elongated strap 502 defines a length extending between a first end and a second end, a first magnetic element 504A proximate the first end of strap 502, and a second magnetic element 504B proximate the second end of strap 502.

Fastener 506 is attached to the first end of strap 502 with pinch fit base 507 of fastener 506 secured to the first end of strap 502. Fastener 508 is attached to the second end of strap 502 with ring base 509 of fastener 508 secured to loop 507 at the second end of strap 502. In the specific example of assembly 500, fastener 506 is a solid ring fastener, and fastener 508 is a spring hook fastener.

Assembly 500 is substantially similar to assembly 100 with the addition of card pockets 512A, 512B. Elongated strap 502 is configured to secure cards within the card pockets 512A, 512B when first magnetic element 504A is magnetically coupled to second magnetic element 504B. For brevity, details of assembly 100 are not repeated with respect to assembly 500.

Figure 6:
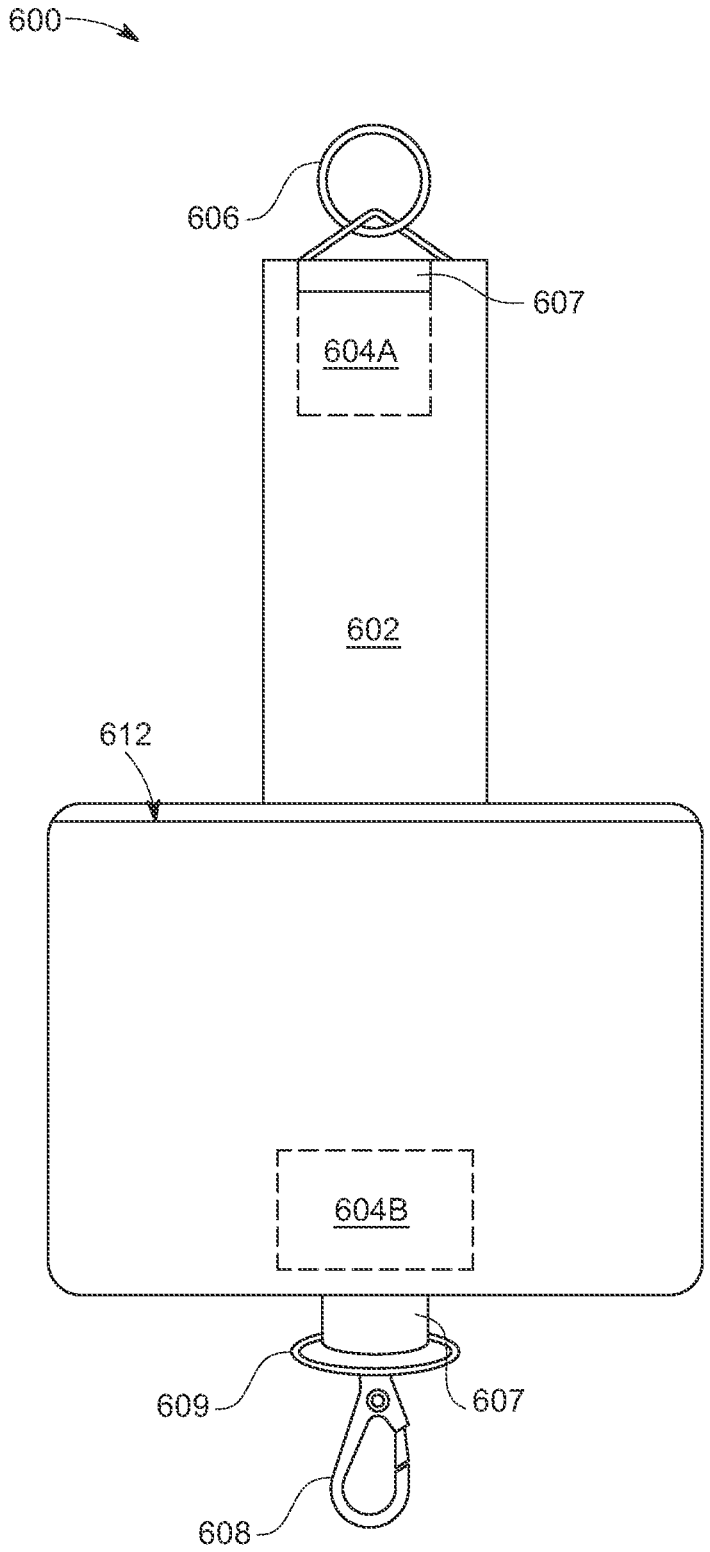

FIG. 6 illustrates assembly 600. Assembly 600 includes elongated strap 602. Elongated strap 602 defines a length extending between a first end and a second end, a first magnetic element 604A proximate the first end of strap 602, and a second magnetic element 604B proximate the second end of strap 602.

Fastener 606 is attached to the first end of strap 602 with pinch fit base 607 of fastener 606 secured to the first end of strap 602. Fastener 608 is attached to the second end of strap 602 with ring base 609 of fastener 608 secured to loop 607 in the second end of strap 602. In the specific example of assembly 600, fastener 606 is a solid ring fastener, and fastener 608 is a spring hook fastener.

Assembly 600 is substantially similar to assembly 100 with the addition of pouch 612. Pouch 612 is secured to elongated strap 602. Elongated strap 602 is configured to secure an object within pouch 612 when first magnetic element 604A is magnetically coupled to second magnetic element 604B. For brevity, details of assembly 100 are not repeated with respect to assembly 600.

Figure 7:
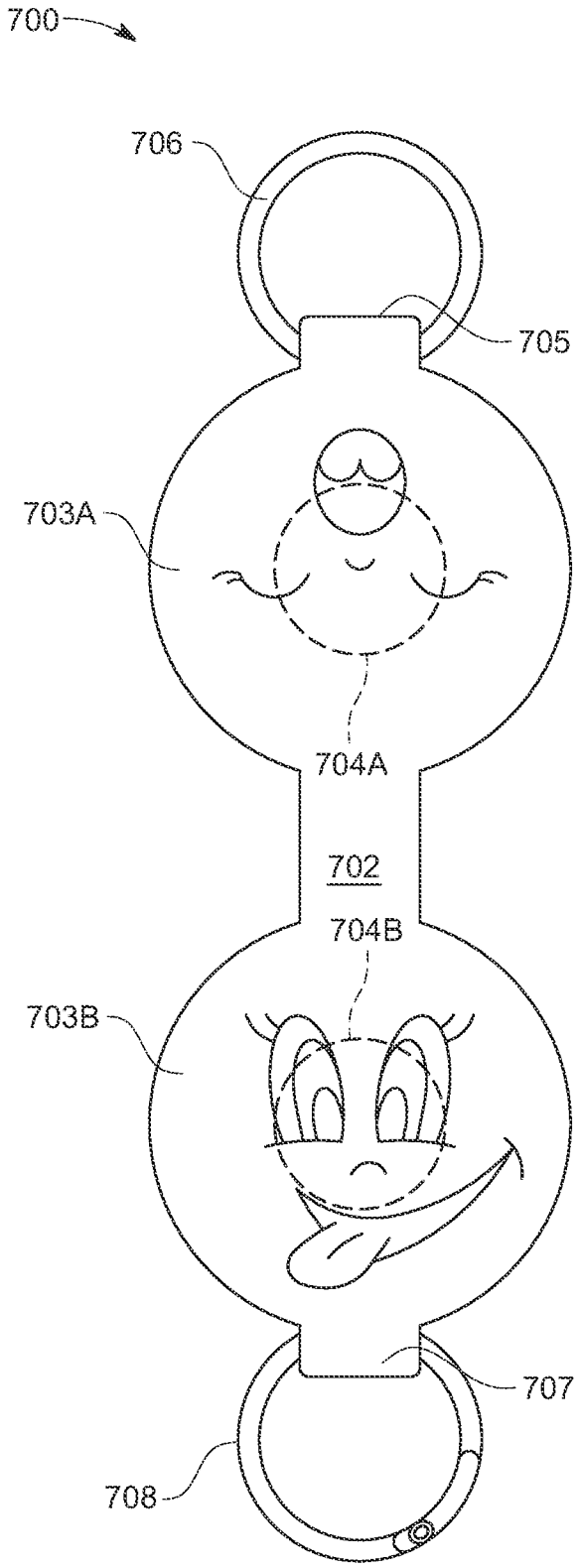

FIG. 7 illustrates assembly 700. Assembly 700 includes elongated strap 702. Elongated strap 702 defines a length extending between a first end and a second end, a first magnetic element 704A proximate the first end of strap 702, and a second magnetic element 704B proximate the second end of strap 702. Magnetic elements 704A, 704B are collectively referred to as magnetic elements 704.

Fastener 706 is attached to the first end of strap 702. Specifically, fastener 706 is a solid ring fastener that extends through hole 705 in the first end of strap 702. Fastener 708 is attached to the second end of strap 702. Specifically, fastener 708 is a hinged opening ring fastener that extends through hole 707 in the second end of strap 702.

Strap 702 is formed from a molded material, such a as a molded a molded polymer, a molded silicon, or a molded rubber. In some examples, elongated strap 702 includes two layers with magnetic elements 704 between the layers such that elongated strap 702 covers magnetic elements 704. For example, elongated strap 702 may be overmolded on magnetic elements 704.

The molded material of strap 702 includes ornamental designs 703A, 703B with a narrowed region to facilitate bending to allow magnetic elements 704 to be magnetically coupled to each other as described with respect to assembly 100.

Any variety of fastener may be selected for one or both of fasteners 706, 708. Such fasteners may represent a clasp, a hook, such as an open hook, a spring-loaded hook or a snap hook, and/or a ring, such as a solid ring, a hinged opening ring, or a split ring.

In various examples, magnetic elements 704 may comprise two permanent magnets or one permanent magnet and one ferromagnetic metal. Such permanent magnets may be permanent magnets comprising iron and/or rare earth magnets.

Figure 8:
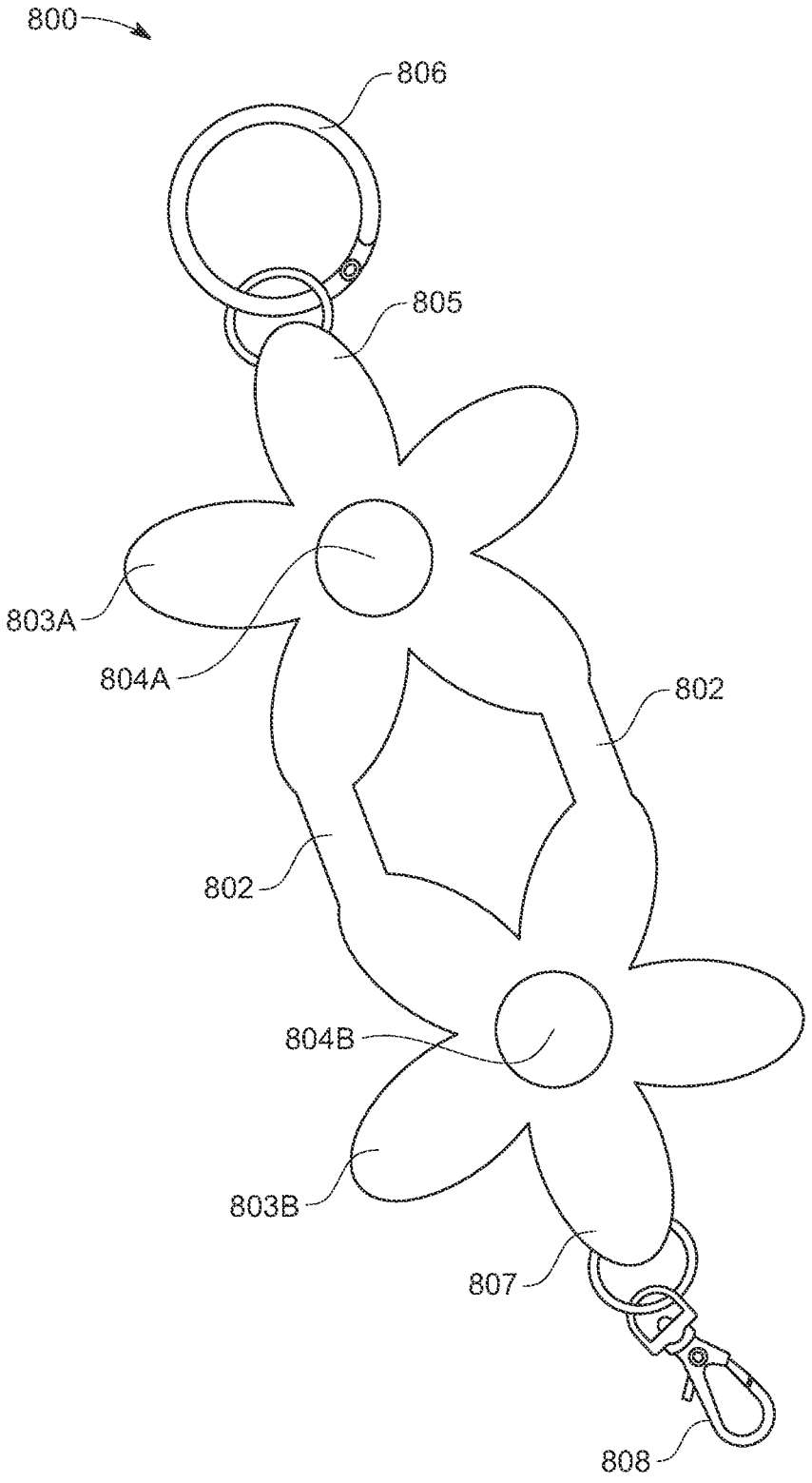

FIG. 8 illustrates assembly 800. Assembly 800 includes elongated strap 802. Elongated strap 802 defines a length extending between a first end and a second end, a first magnetic element 804A proximate the first end of strap 802, and a second magnetic element 804B proximate the second end of strap 802. Magnetic elements 804A, 804B are collectively referred to as magnetic elements 804.

Fastener 806 is attached to the first end of strap 802. Specifically, fastener 806 is a solid ring fastener that extends through hole 805 in the first end of strap 802. Fastener 808 is attached to the second end of strap 802. Specifically, fastener 808 is a hinged opening ring fastener with a ring that extends through hole 807 in the second end of strap 802.

Strap 802 is formed from a molded material, such a as a molded a molded polymer, a molded silicon, or a molded rubber. In some examples, elongated strap 802 includes two layers with magnetic elements 804 between the layers such that elongated strap 802 covers magnetic elements 804. For example, elongated strap 802 may be overmolded on magnetic elements 804.

Assembly 800 is substantially similar to assembly 700 except that elongated strap 802 includes a bifurcated portion between ornamental designs 803A, 803B. The bifurcated portion facilitates bending to allow magnetic elements 804 to be magnetically coupled to each other as described with respect to assembly 700. For brevity, details of assembly 700 are not repeated with respect to assembly 800.

Figure 9:
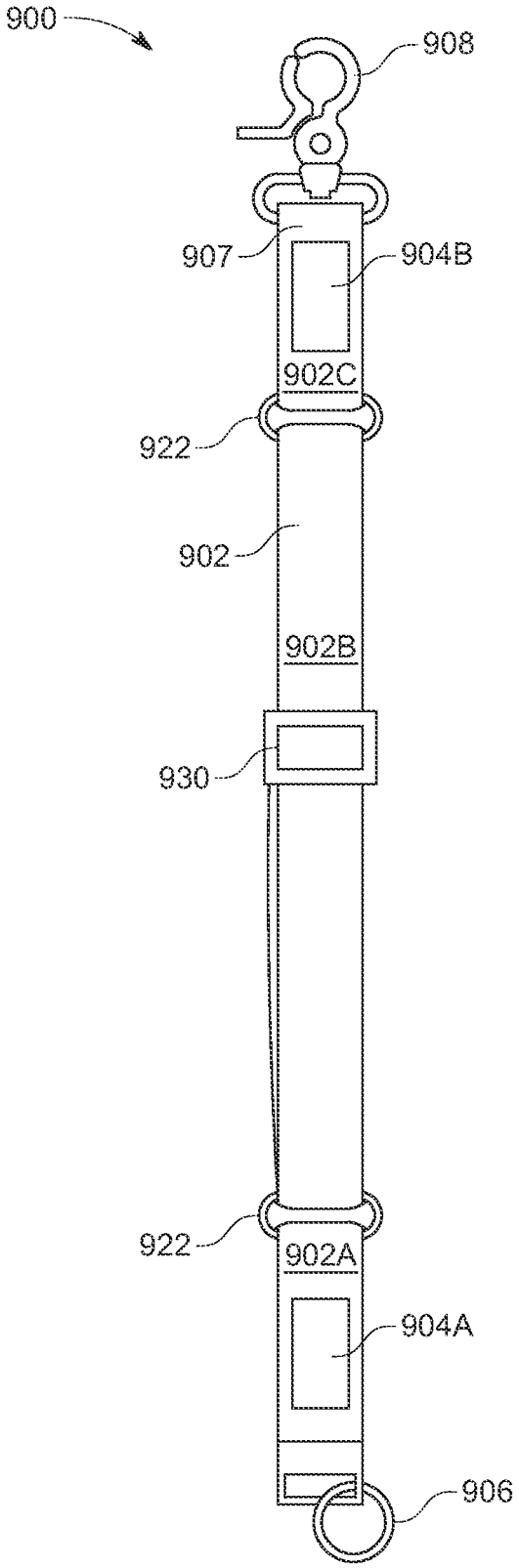

FIG. 9 illustrates assembly 900. Assembly 900 includes elongated strap 902. Elongated strap 902 defines a length extending between a first end and a second end, a first magnetic element 904A proximate the first end of strap 902, and a second magnetic element 904B proximate the second end of strap 902.

Fastener 906 is attached to the first end of strap 902 through loop 905 of strap 902. Fastener 908 is attached to the second end of strap 902 through loop 907 of strap 902. In the specific example of assembly 900, fastener 906 is a ring fastener, and fastener 908 is a clasp fastener, such as a lobster claw clasp. Fastener 908 includes an optional swivel between loop 907 and the clasp mechanism.

Assembly 900 is substantially similar to assembly 100 except elongated strap 902 includes multiple strap segments interconnected by a ring to form elongated strap 902. Specifically, elongated strap 902 includes three separate strap segments: 902A, 902B, 902C. Strap segments 902A, 902B, 902C are connected by ring strap fastener buckles 922. Ring strap fastener buckles 922 pass through loops in the ends of strap segments 902A, 902B, 902C to interconnect the segments 902A, 902B, 902C into a single elongated strap 902. Center strap segment 902B includes a slider guide buckle 930 which facilitates changing the length of center strap segment 902B, and thereby the length of elongated strap 902. Specifically, slider guide buckle 930 changes the size of the loop connecting strap segment 902B to strap segment 902A via strap fastener buckle 922. For brevity, details of assembly 100 are not repeated with respect to assembly 900.

FIGS. 10A-10H illustrate example fasteners, including clasps, rings and hooks, that may be incorporated into any of assemblies 100, 200, 300, 400, 500, 600, 700, 800, 900. For example, any of the fasteners of FIGS. 10A-10H may be used in place of the fasteners illustrated with respect to assemblies 100, 200, 300, 400, 500, 600, 700, 800, 900.

Figure 10A:
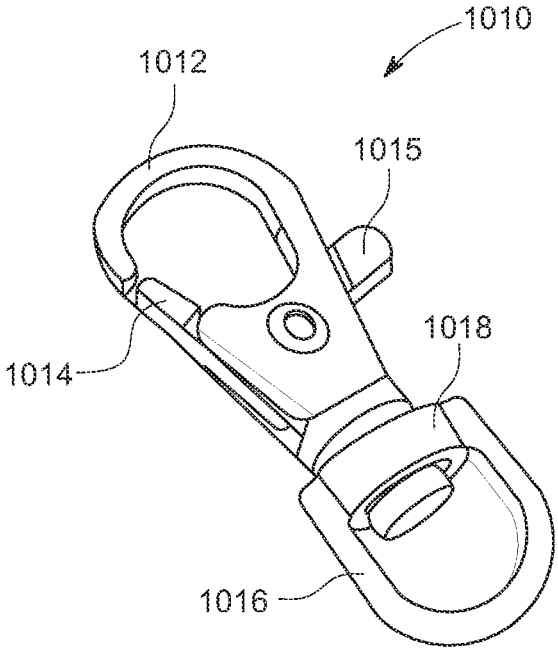
FIGS. 10A-10H illustrate example fasteners, including clasps, rings and hooks, that may be incorporated into any of assemblies 100, 200, 300, 400, 500, 600, 700, 800, 900.

FIG. 10A illustrates lobster claw clasp 1010. Clasp 1010 includes a hook 1012, with a spring-loaded, pivoting, closure mechanism 1014. Pivoting closure mechanism 1014 is biased in the closed position, and includes a release tab 1015 that may be pressed by a user to open mechanism 1014. Hook 1012 is connected to ring 1016 with a swivel 1018.

Figure 10B:
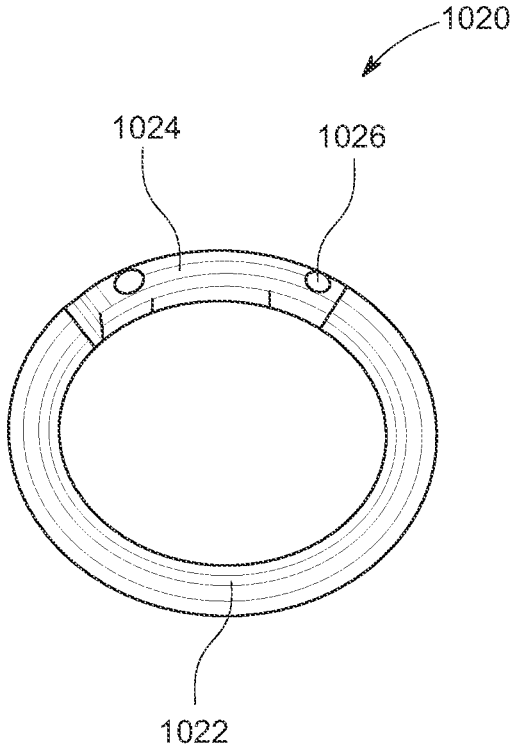

FIG. 10B illustrates hinged opening ring 1020. Ring 1020 includes solid ring portion 1022, and a pivotable ring segment 1024 attached to solid ring portion 1022 with hinge 1026.

Figure 10C:
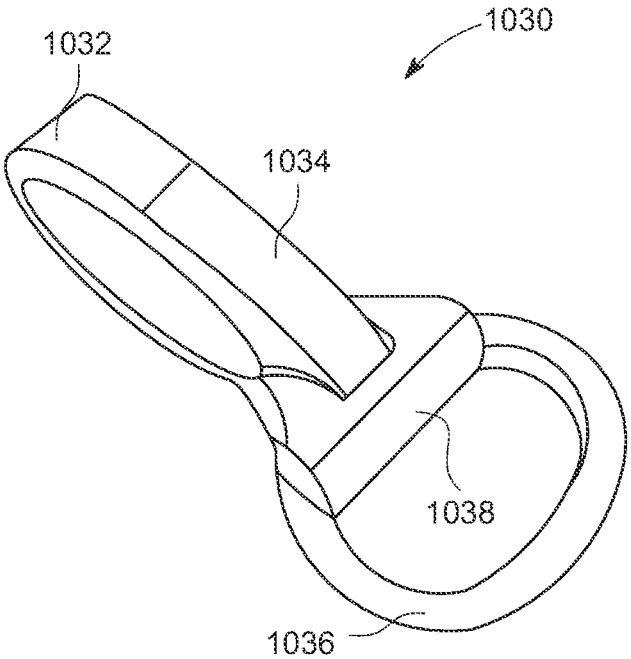

FIG. 10C illustrates clasp 1030. Clasp 1030 includes a hook 1032, with a spring-loaded, pivoting, closure mechanism 1034. Pivoting closure mechanism 1034 is biased in the closed position, and may be pressed by a user to open mechanism 1034. Hook 1032 is connected to ring 1036 with a hinge 1038.

Figure 10D:
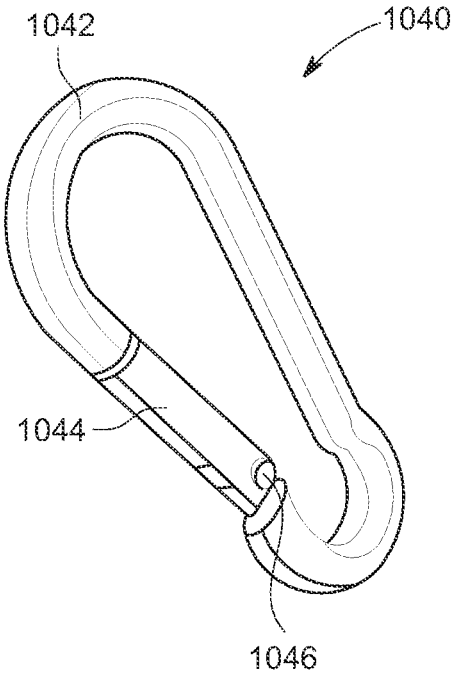

FIG. 10D illustrates carabiner clip 1040. Carabiner 1040 includes solid loop portion 1042, and a pivotable segment 1044 attached to solid loop portion 1042 with hinge 1046.

Figure 10E:
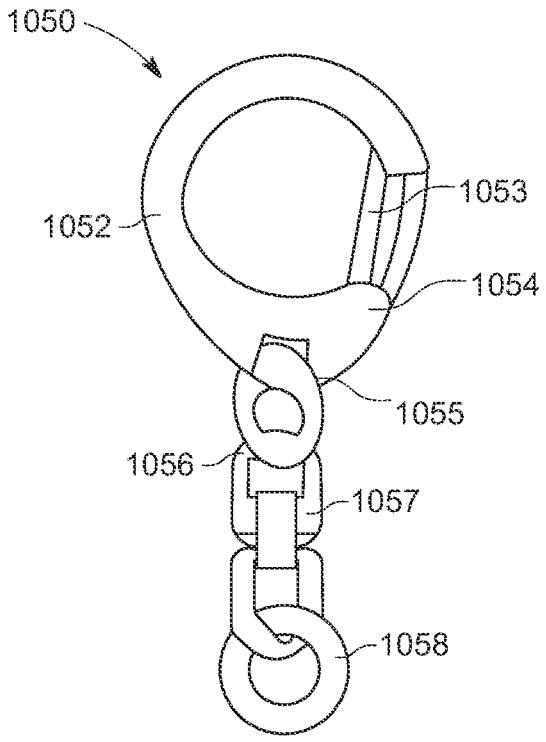

FIG. 10E illustrates hinged opening ring and chain 1050. Ring and chain 1050 includes solid ring portion 1052, and a pivotable segment 1053 attached to solid ring portion 1052 with hinge 1054. Solid ring portion 1052 forms a hole 1055. Chain 1056 includes an end link through hole 1055, and a swivel 1057. End loop 1058 of chain 1056 supports attachment to a strap of one of assemblies 100, 200, 300, 400, 500, 600, 700, 800, 900.

Figure 10F:
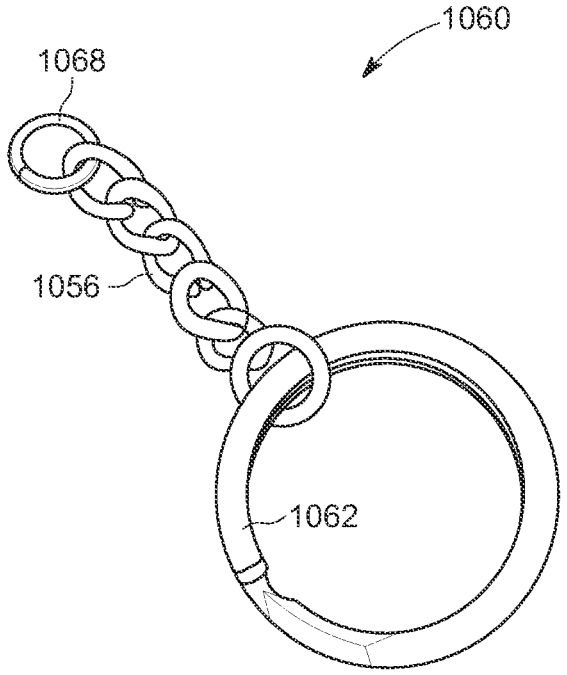

FIG. 10F illustrates split ring and chain 1060. Ring and chain 1060 includes split ring portion 1062. Chain 1066 includes a ring through split ring portion 1062. End loop 1068 of chain 1066 supports attachment to a strap of one of assemblies 100, 200, 300, 400, 500, 600, 700, 800, 900.

Figure 10G:
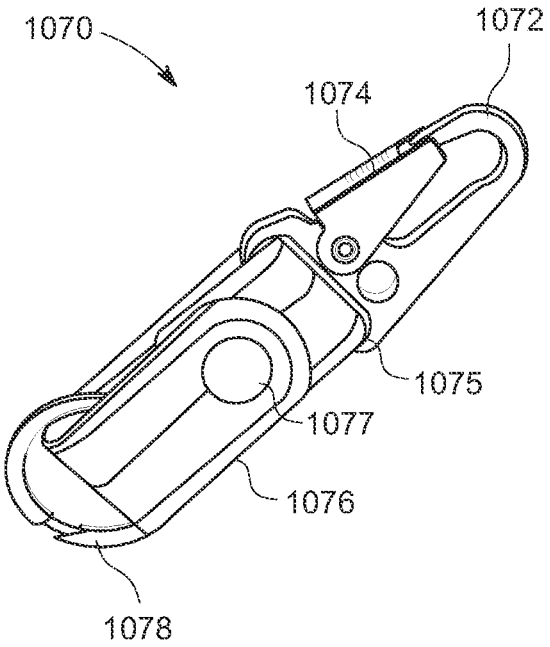

FIG. 10G illustrates clasp and strap 1070. Clasp and strap 1070 includes a hook 1072, with a spring-loaded, pivoting, closure mechanism 1074. Pivoting closure mechanism 1074 is biased in the closed position, and may be pressed by a user to open mechanism 1074. Hook 1072 is connected to split ring 1078 with a strap 1076. Strap 1076 is looped through both ring 1078 and hole 1075 of hook 1072. Strap 1076 includes a snap 1077, which can be opened to release ring 1078 from hook 1072. End loop ring 1078 supports attachment to a strap of one of assemblies 100, 200, 300, 400, 500, 600, 700, 800, 900. In one particular example, clasp and strap 1070 may replace fastener 211 in assembly 200.

Figure 10H:
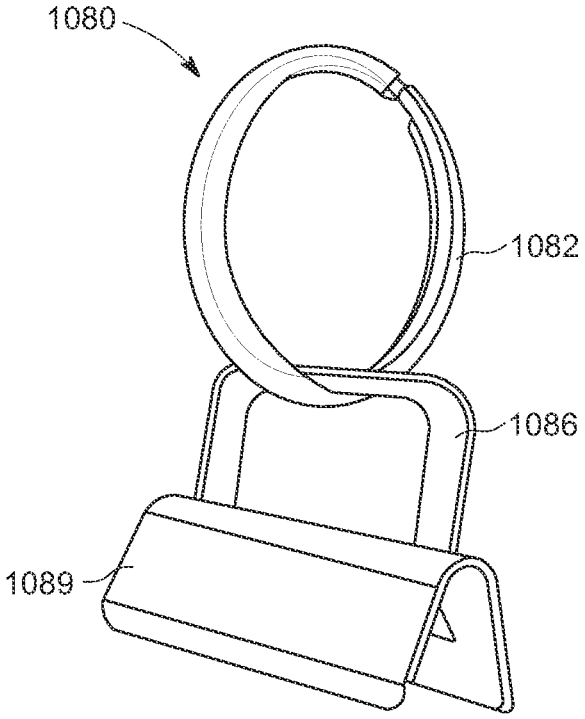

FIG. 10H illustrates fastener 1080, including a pinch fit base 1089 with a solid loop 1086 and a split ring 1082 through solid loop 1086. Pinch fit base 1089 may be bent to permanently attach fastener 1080 to a strap of one of assemblies 100, 200, 300, 400, 500, 600, 700, 800, 900.

The specific techniques for an assembly including an elongated strap with two magnetic elements and a fastener on an end of the elongated strap, such as techniques embodied by assemblies 100, 200, 300, 400, 500, 600, 700, 800, 900 are merely illustrative of the general inventive concepts included in this disclosure as defined by the following claims.

The invention claimed is:

1. An assembly comprising:

an elongated strap with a length extending between a first end and a second end;

a first magnetic element proximate the first end of the strap;

a second magnetic element proximate the second end of the strap, wherein the first magnetic element can magnetically couple to the second magnetic element to form a loop with the elongated strap;

a clasp fastener attached to the first end of the strap; and a loop fastener attached to the second end of the strap, wherein the clasp fastener is attachable to the loop fastener to secure the loop formed from the elongated strap.

2. The assembly of claim 1, wherein the clasp fastener is selected from a group consisting of:

a lobster claw clasp;

a spring-loaded hook; and a snap hook.

3. The assembly of claim 1, wherein the first end of the elongated strap includes a loop attaching the clasp fastener to the elongated strap.

4. The assembly of claim 1, wherein the clasp fastener includes a pinch fit base attaching the fastener to the elongated strap.

5. The assembly of claim 1, wherein the loop fastener is selected from a group consisting of:

a solid ring;

a hinged opening ring;
a split ring;
a clasp;
a lobster claw clasp;
a spring-loaded hook; and
a snap hook.

6. The assembly of claim 1, further comprising a third fastener including a loop slidable over the elongated strap.

7. The assembly of claim 1, wherein the first magnetic element is selected from a group consisting of:
a ferromagnetic metal;
a permanent magnet comprising iron; and
a rare earth magnet.

8. The assembly of claim 1, wherein the elongated strap covers the first magnetic element and the second magnetic element.

9. The assembly of claim 1, wherein the elongated strap is formed from one or more of a group consisting of:
a woven fabric;
a molded polymer;
a molded silicon;
a molded rubber; and
a leather.

10. The assembly of claim 1, wherein the elongated strap includes a pocket and a cover, the cover being configured to close an opening of the pocket when the first magnetic element is magnetically coupled to the second magnetic element.

11. The assembly of claim 1, wherein the elongated strap includes at least two card pockets, the elongated strap being configured to secure cards within the card pockets when the first magnetic element is magnetically coupled to the second magnetic element.

12. The assembly of claim 1, wherein the elongated strap includes a pouch, the elongated strap being configured to secure objects within the pouch when the first magnetic element is magnetically coupled to the second magnetic element.

13. The assembly of claim 1, wherein the elongated strap includes a bifurcated portion between the first end and the second end.

14. The assembly of claim 1, wherein the elongated strap includes multiple strap segments interconnected by a ring to form the elongated strap.

15. The assembly of claim 1, further comprising a cloth, wherein the first magnetic element is magnetically coupled to the second magnetic element with the cloth pinched between the first magnetic element and the second magnetic element.

16. The assembly of claim 15, wherein the cloth is part of one of a group consisting of:
a purse; and
an article of clothing.

17. A method comprising:
obtaining a cloth; and
attaching an assembly to the cloth, wherein the assembly includes:
an elongated strap with a length extending between a first end and a second end;
a first magnetic element proximate the first end of the strap;
a second magnetic element proximate the second end of the strap,
wherein the first magnetic element can magnetically couple to the second magnetic element to form a loop with the elongated strap;
a clasp fastener attached to the first end of the strap; and
a loop fastener attached to the second end of the strap,
wherein the clasp fastener is attachable to the loop fastener to secure the loop formed from the elongated strap,
wherein attaching the assembly to the cloth includes magnetically coupling the first magnetic element to the second magnetic element with the cloth pinched between the first magnetic element and the second magnetic element.

18. The method of claim 17, wherein the cloth is part of one of a group consisting of:
a purse; and
an article of clothing.

19. The method of claim 17, further comprising securing an object to the assembly with the fastener.

20. The method of claim 17, wherein the clasp fastener is selected from a group consisting of:
a lobster claw clasp;
a spring-loaded hook; and
a snap hook.

* * * * *